US010533828B2

(12) United States Patent
Oliphant

(10) Patent No.: US 10,533,828 B2
(45) Date of Patent: Jan. 14, 2020

(54) QUICK CHANGE TARGET SYSTEM

(71) Applicant: Backyard Intellectual Property Holdings LLC, Eatontown, NJ (US)

(72) Inventor: Mark Oliphant, Lakehurst, NJ (US)

(73) Assignee: Backyard Intellectual Property Holdings LLC, Eatontown, NJ (US)

( * ) Notice: Subject to any disclaimer, the term of this patent is extended or adjusted under 35 U.S.C. 154(b) by 0 days.

(21) Appl. No.: 16/007,210

(22) Filed: Jun. 13, 2018

(65) Prior Publication Data

US 2018/0364014 A1 Dec. 20, 2018

Related U.S. Application Data

(60) Provisional application No. 62/518,671, filed on Jun. 13, 2017.

(51) Int. Cl.
*F41J 1/10* (2006.01)

(52) U.S. Cl.
CPC ..... *F41J 1/10* (2013.01)

(58) Field of Classification Search
CPC ..... F41J 1/00; F41J 1/10; F41J 3/00; F41J 3/0004
USPC ..... 273/403–408
See application file for complete search history.

(56) References Cited

U.S. PATENT DOCUMENTS 1,364,010 A * 12/1920 Tyerman ..... F41J 1/10 273/407
2,069,822 A * 2/1937 Douglas ..... F41J 1/10 220/683
3,415,519 A * 12/1968 Hand ..... F41J 1/10 248/170
3,512,778 A * 5/1970 Allen ..... F41J 3/0004 273/403
3,737,166 A * 6/1973 Knight ..... F41J 1/10 273/372
4,706,963 A * 11/1987 Geuss ..... B25B 5/003 250/495.1
4,813,684 A * 3/1989 Bruno ..... F41J 1/10 273/403
6,994,347 B2 * 2/2006 Tessel ..... F41J 5/048 273/373
6,997,423 B1 * 2/2006 Nudo, Jr. ..... G09F 7/10 248/156
D720,016 S * 12/2014 McDowell ..... D21/302
D735,833 S * 8/2015 Winstead ..... D22/113
2011/0169223 A1 * 7/2011 Reed ..... F41J 1/10 273/403
2012/0200042 A1 * 8/2012 Kelly ..... A63F 9/0208 273/408
2015/0069709 A1 * 3/2015 Doria ..... F41J 1/10 273/407

FOREIGN PATENT DOCUMENTS

WO WO-9015964 A1 * 12/1990 ..... F41J 3/0004

* cited by examiner

*Primary Examiner* — Mark S Graham
(74) *Attorney, Agent, or Firm* — Eric J. Sosenko; Jonathan P. O'Brien; Honigman LLP

(57) ABSTRACT

A quick change target system including a frame, a target mounted to the frame, and a retainer movable between a first position retaining the target within the frame and a second position permitting removal of the target from the frame. The target is formed from a plurality of individual members that have markings, which collectively define aiming points on the target.

19 Claims, 8 Drawing Sheets

QUICK CHANGE TARGET SYSTEM

CROSS-REFERENCE TO RELATED APPLICATIONS

This application is a non-provisional application claiming priority to U.S. Patent Application No. 62/518,671, filed Jun. 13, 2017, the entire contents of which is herein incorporated by reference.

BACKGROUND

1. Field of the Invention

The present invention generally relates to targets that are used in connection with, and which are impacted by, projected objects. More specifically, the invention relates to a system that allows for the quick changing and replacement of the target after a period of use.

2. Description of Related Art

Target sports cover a wide variety of sports in which an object is projected at a target. These sports vary from shooting sports, which may involve the projecting of a bullet, arrow, bolt or other object at the target, to throwing sports, which may involve throwing a dart, hatchet, axe, knife or other object at the target. In each instance, however, the target eventually succumbs to repeated impacts and becomes degraded to the point where the target needs to be replaced.

In facilities offering such target sports, being able to quickly replace a spent target with a new target has convenience, safety and economic advantages.

SUMMARY

In satisfying the above need, being able to quickly replace a spent target with a new target, as well as overcoming various drawbacks and other limitations of the related art, the present disclosure describes a quick change target system as might be used in connection with the sport of hatchet throwing. While discussed in connection with hatchet throwing, it will be readily appreciated that the quick change target system described herein is not intended to be limited to hatchet throwing and that the system has applicability to a wide spectrum of target sports.

Accordingly, in an aspect of the invention, a quick change target system is provided having a target, a frame having a pair of channels and a retainer movable between a first position retaining the target within the frame and a second position permitting removal of the target from the frame. The frame includes a pair of channels defined by opposing side walls, a bottom wall extending between the side walls, and an open top. The channels are provided on the frame with the open tops facing one another. The channels also include at least one open end. The target is received in the frame and has a first side located in one of the channels and a second side located in the other of the channels.

In another aspect, in the second position of the retainer, the target is laterally removable from the frame through the open ends of the channels.

In a further aspect, the retainer is at least one of rotationally movable relative to the target or axially movable relative to the target.

In still another aspect, the retainer is a clamp, the clamp including a clamp jaw that is axially movable in a direction aligned with a length of the channel.

In an additional aspect, the clamp jaw is configured to engage a side edge of the target.

In yet a further aspect, a portion of the channel is defined by a sacrificial member.

In another aspect, the sacrificial member defines a front surface of the quick change target system.

In an additional aspect, the target is defined by a plurality of individual members loosely received within and extending between the channels.

In yet another aspect, the individual members are provided in the form of dimensional lumber.

In still a further aspect, the individual members each include indicia on a face thereof, the indicia collectively defining at least one aiming point on the target.

In an aspect of the invention, a quick change target system is provided having a target and a frame configured to removably receive and support the target. The frame has a skeletal structure including a pair of opposing rails connected by transverse rails extending between the opposing rails. The opposed rails include receiving portions that loosely receive the target such that the target extends between the receiving portions. The system further includes a retainer mechanism with a target retaining portion that is movable between a first position permitting withdrawal of the target from the receiving portions and a second position preventing withdrawal of the target from the receiving portions.

In another aspect, the retainer mechanism is a clamp.

In a further aspect, the target retainer portion is a moveable clamp jaw.

In an additional aspect, the target retainer portion is movable in at least one of a direction linearly toward the target or rotationally relative to the target.

In still another aspect, the target retainer portion is movable in a direction linearly toward a lateral side of the target.

Yet in a further aspect, a portion of the channel is defined by a sacrificial member.

In an additional aspect, the target is defined by a plurality of individual members loosely received within and extending between the channels.

In still a further aspect, the individual members are provided in the form of dimensional lumber.

In yet another aspect, the individual members each include indicia on a face thereof, the indicia collectively defining at least one aiming point on the target.

In another aspect of the invention, a quick change target system is provided having a target, the target being defined by a plurality of individual members, the individual members each including indicia on a face thereof that collectively defines at least one aiming point on the target; a frame configured to removably receive and support the target, wherein the frame has a skeletal structure including a pair of opposing rails and transverse rails extending between the opposing rails. The opposed rails including receiving portions loosely receiving the target, which extends between the receiving portions. The target system also including a retainer mechanism. The retainer mechanism includes an end stop on one side of the frame and a target retaining portion on an opposing side of the frame. The target retaining portion is movable between a first position permitting withdrawal of the target from the receiving portions and a second position preventing withdrawal of the target from the receiving portions, whereby the target is retained with the frame between the end stop and the target retaining portion.

Further objects, features and advantages of this invention will become readily apparent to persons skilled in the art after review of the following description with reference to the drawings and the claims that are appended to and form a part of this specification.

DETAILED DESCRIPTION

As used in the description that follows, directional terms such as "upper" and "lower" are used with reference to the orientation of the elements as presented in the figures. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part, whether or not such an axis is designated in the figure. An axial surface is therefore one that faces in the axial direction. In other words, an axial surface faces in a direction along the axis. A radial surface therefore faces radially, generally away from or toward the axis. It will be understood, however, that in actual implementation, the directional references used herein may not necessarily correspond with the installation and orientation of the corresponding components or device. For example, elements described as having a right or upper orientation may have a left or lower orientation when installed for actual use.

Figure 1:
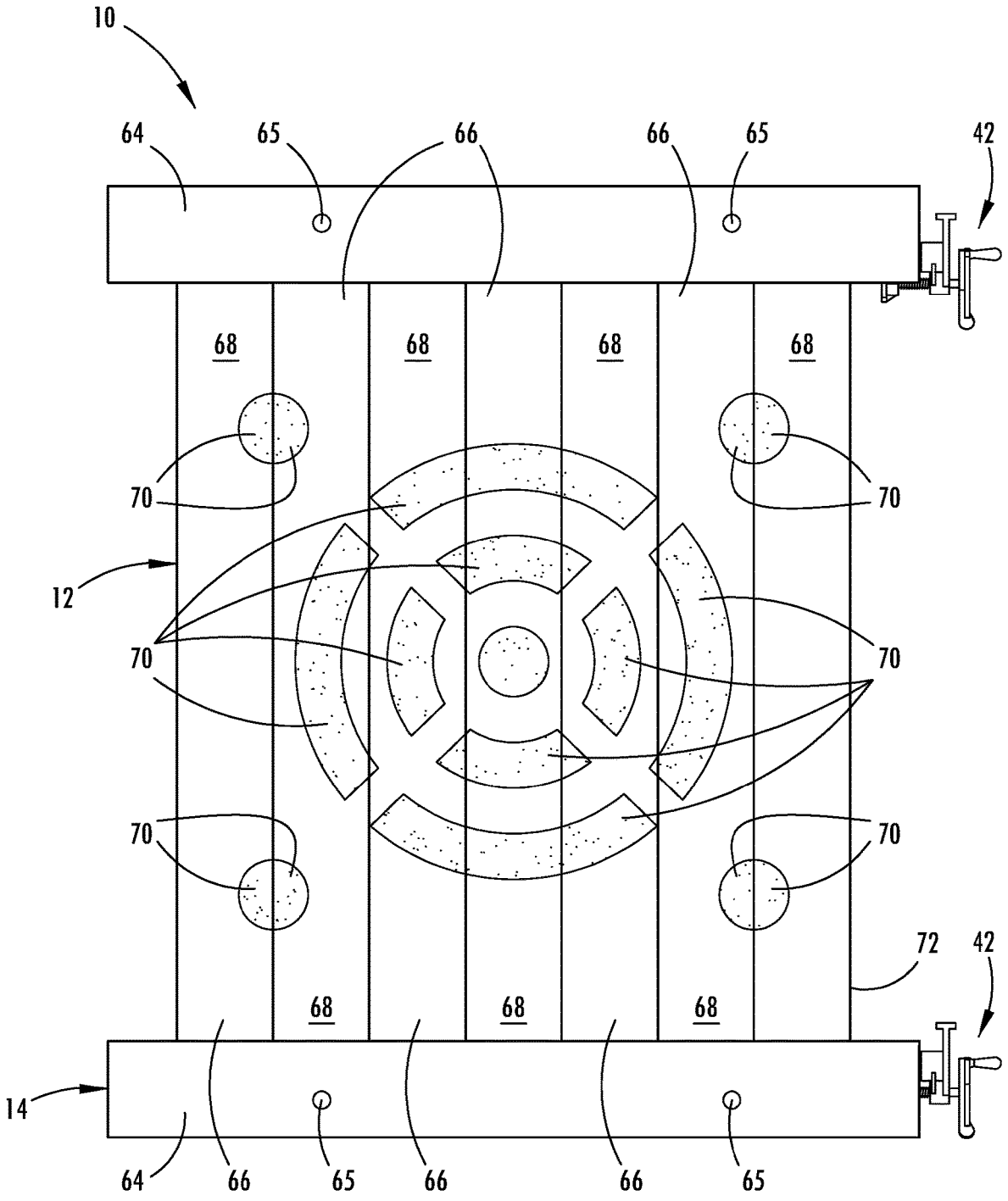
FIG. 1 is front view of a fully assembled target system incorporating the principles of the present invention.
Figure 2:
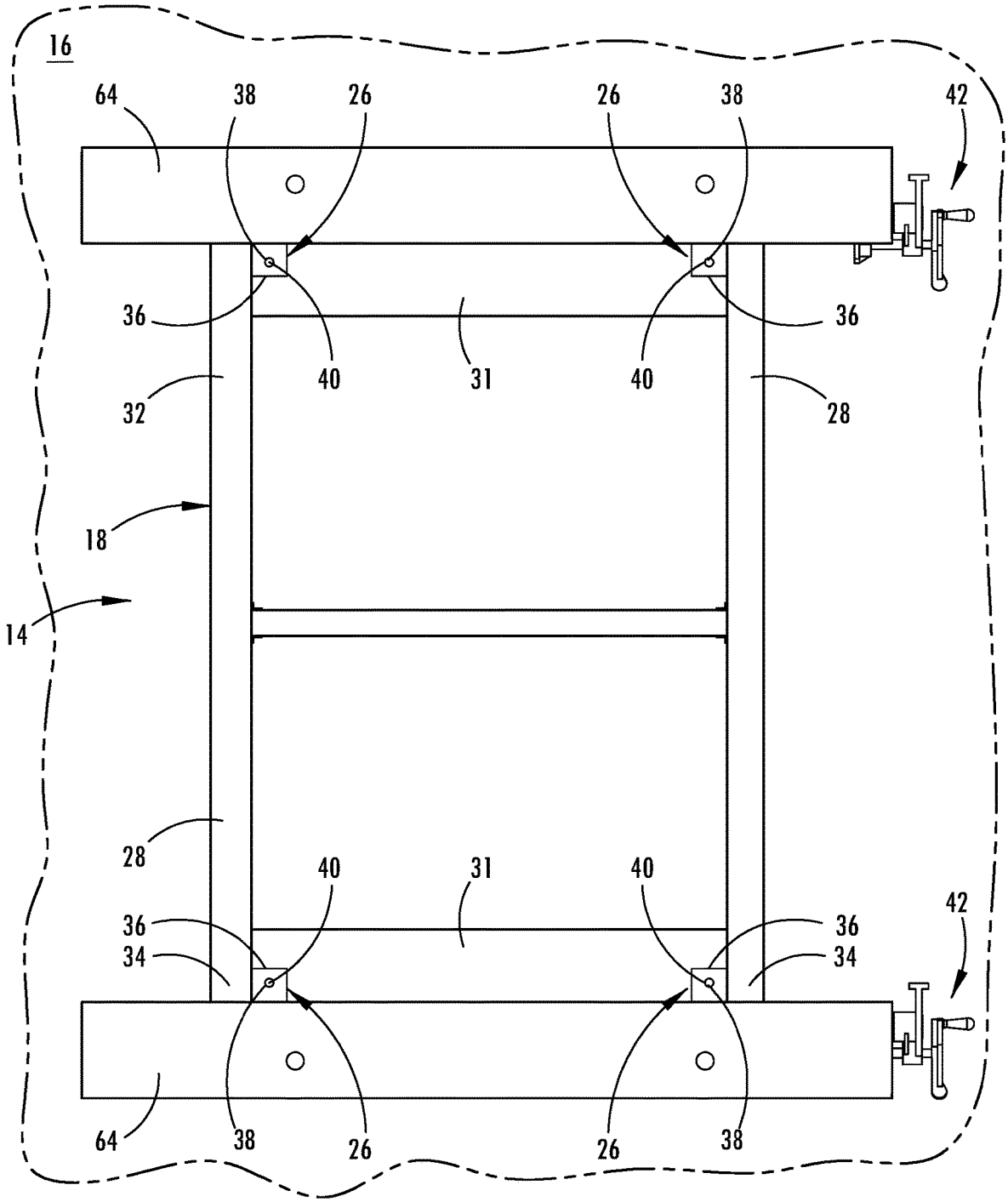
FIG. 2 is a front plan view of the frame of the target system seen in FIG. 1, with the target removed and showing the upper and lower sacrificial members attached to the sub-frame.
Figure 3:
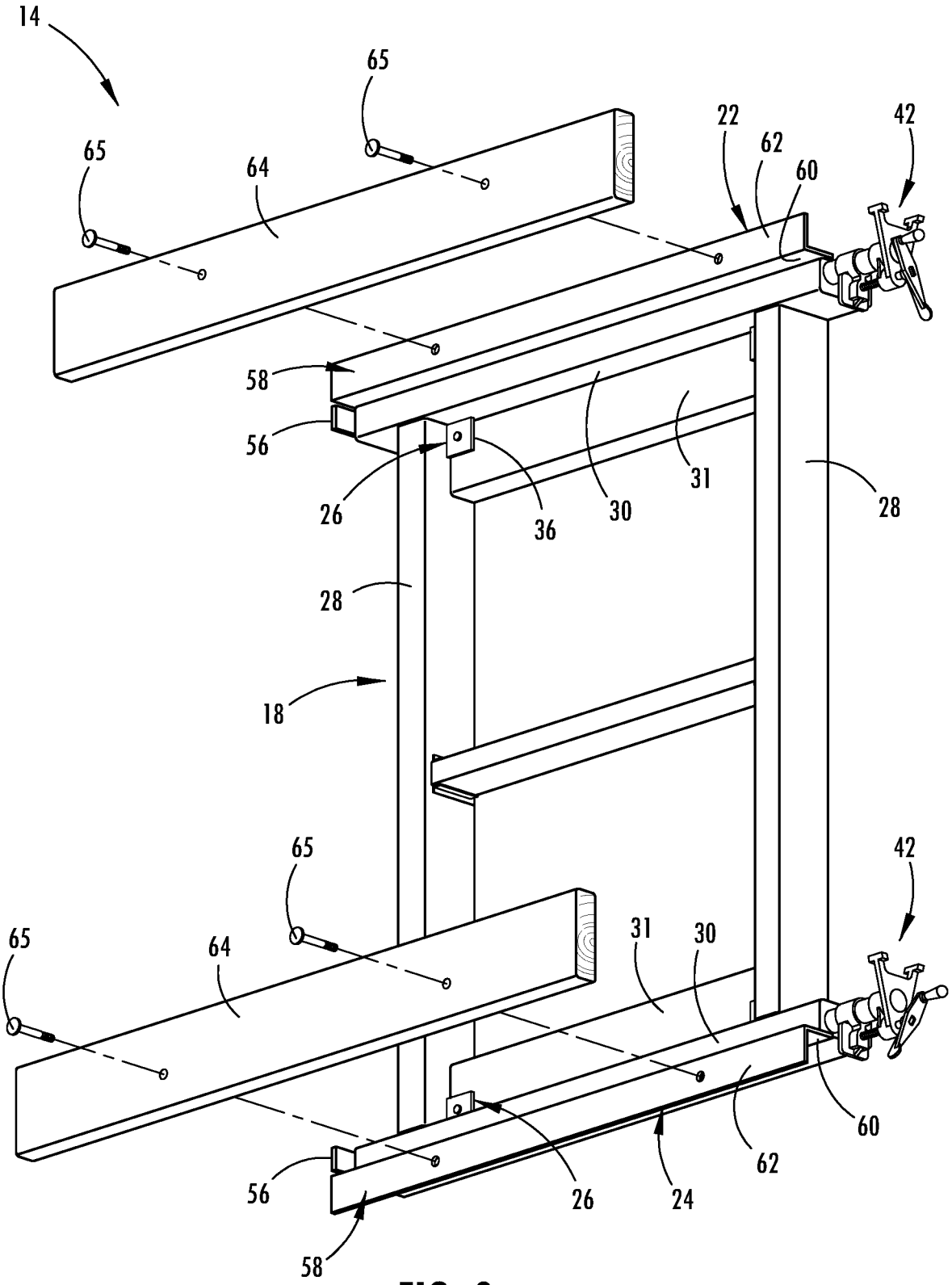
FIG. 3 is an exploded perspective view of the frame of the target system.

Referring now to the figures, a quick change target system (hereafter just "target system") embodying the principles of the present invention is illustrated in FIG. 1 and designated at 10. As seen therein, as its principal components the target system 10 includes a target 12 and a frame 14. In the illustrated embodiment, the target system 10 is configured to be mounted to a vertical structure, such as a wall or pole (and is shown mounted to a wall 16). However, as will be readily appreciated, the target system 10 could alternative be configured with legs so as to be free standing or configured to be mounted to a separate stand. Such alternative configurations are therefore within the purview of the embodiments described herein.

The frame 14 generally includes a skeletal structure or sub-frame 18 having opposing side members 20, an upper part 22, a lower part 24 and mounting means 26 by which the sub-frame 18 is mounted to the support structure (e.g. wall 16). As shown in FIGS. 2-5, the side members 20 of the sub-frame are provided as opposing right and left side rails 28. The side rails 28 are connected to one another by upper and lower end rails 30, which respectively extend between the upper and lower ends 32, 34 of the right and left side rails 28. Also provided at the ends 32, 34 of the left and right side rails 28, interiorly thereof, are transverse rails 31. As shown, all of the side rails 28, end rails 30 and transverse rails 31 are constructed from box or tubular steel beams and welded together to form an integrated structure. Alternatively, the side rails could be constructed of other rigid structural members of various materials.

Corner brackets or flanges 36 are provided at the interior corners formed by the side rails 28, end rails 30 and transverse rails 31, and are welded therebetween. The corner brackets 36 increase the rigidity of the sub-frame 18 and also, in the illustrated embodiment, double as the mounting means 26 for mounting the frame 14 to the wall 16. To enable mounting in the illustrated embodiment, apertures 38 are formed through the corner brackets 36 and through the transverse rails 31. A screw, bolt or other fastener 40 may be inserted through the aperture 38 to attach the frame 14 to the wall 16, a feature of the wall, such as a ledger board, or to another support structure, such as a stand.

Alternatively, brackets can be provided so as to extend from either the side rails 28, the end rails 30 or the transverse rails 31 to facilitate mounting the frame 14 to the wall 16 or other support structure.

The upper and lower parts 22, 24 of the frame 14 are preferably formed, but need not be formed, as mirror images of each other. This allows the target system 10 to be oriented as desired on the wall 16 or as required by the installation location.

Figure 4:
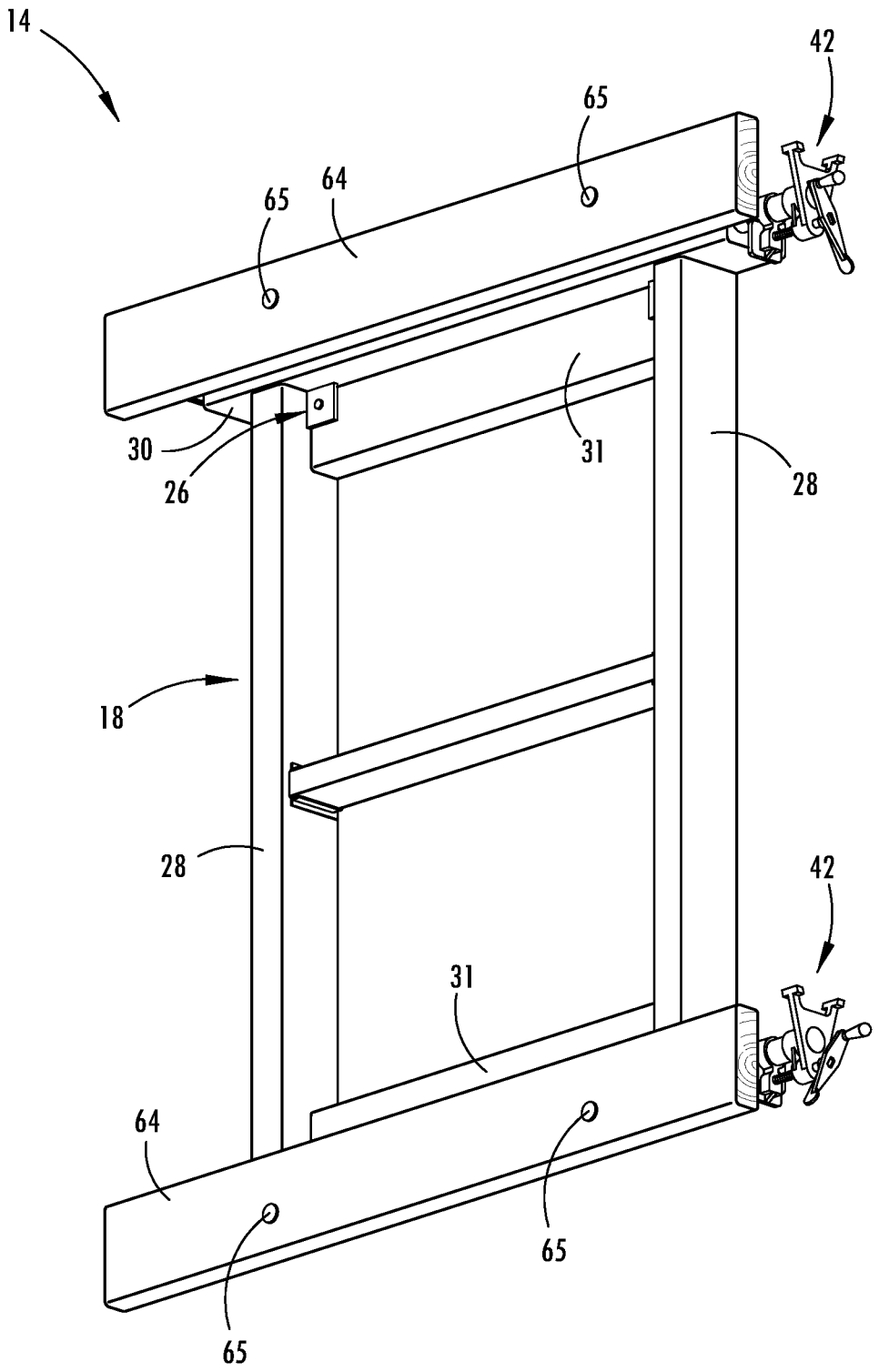
FIG. 4 is an assembled perspective view of the frame of the target system.
Figure 4A:
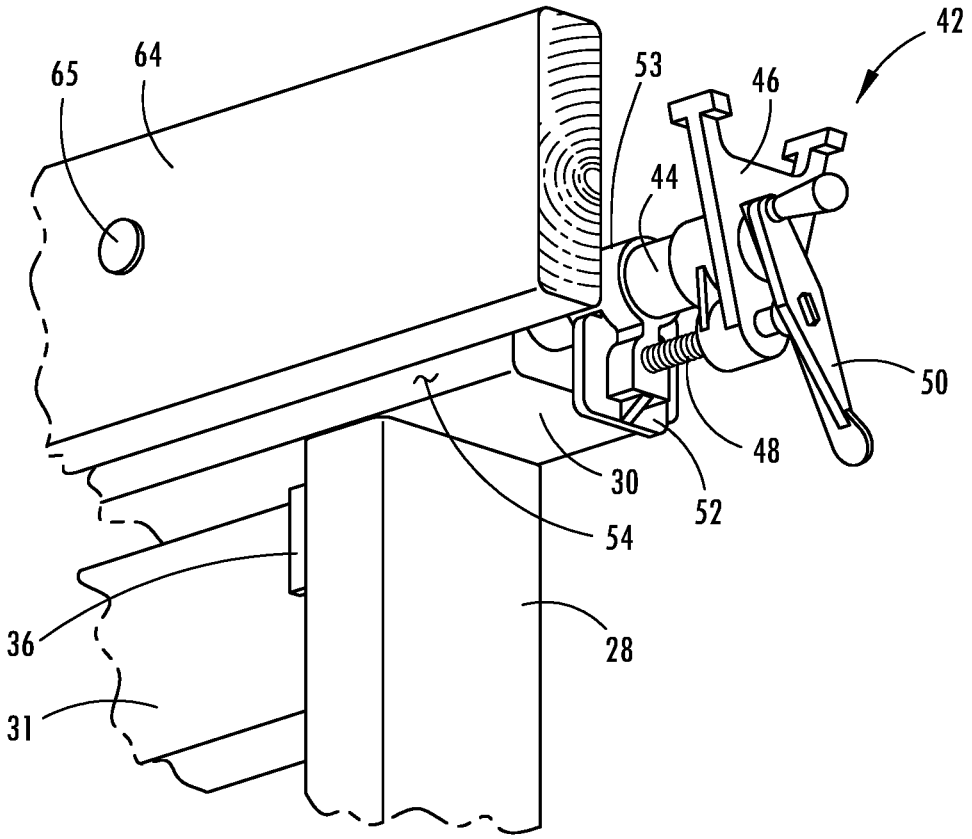
FIG. 4A is an enlarged, upper right side view of the upper part of the sub-frame, the upper sacrificial member and the upper clamp for securing the target in place.
Figure 4B:
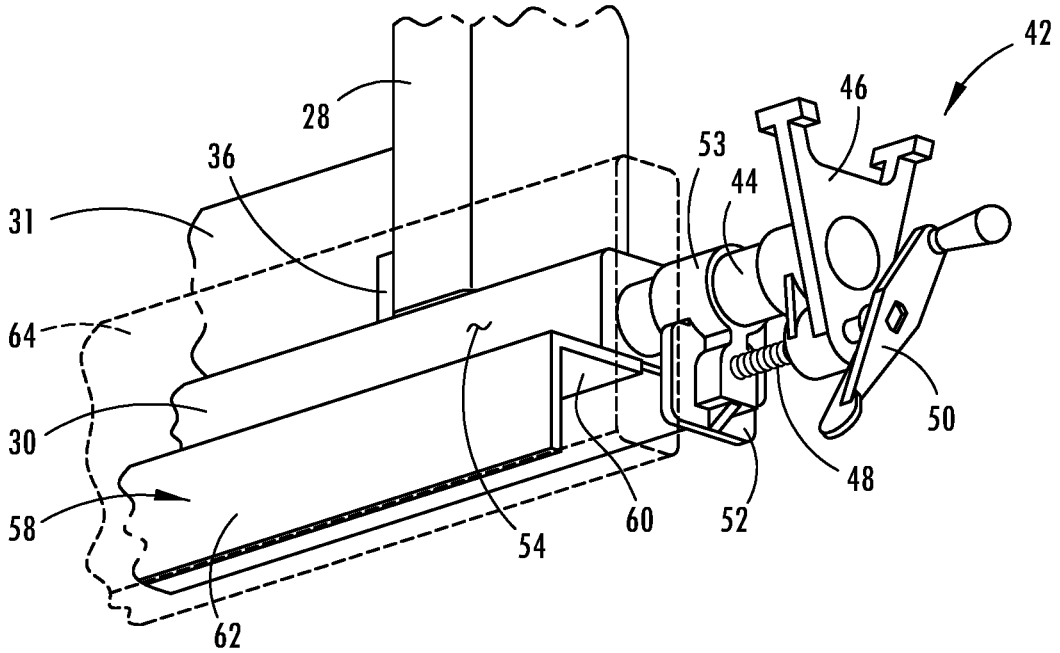
FIG. 4B is an enlarged lower right side view of the lower part of the sub-frame, the lower sacrificial member and the lower clamp for securing the target in place.

As perhaps best seen in FIGS. 4A and 4B, provided on the right end of each of the upper and lower end rails 30 is a target retaining mechanism or retainer 42, which in the preferred embodiment is in the form of a clamp (hereafter just "clamp 42"). The illustrated clamps 42 are generally of a pipe clamp construction in which the pipes 44 of the clamps 42 are respectively welded or otherwise secured to the terminal ends or other portions of the upper or lower end rails 30. A clamp frame 46 is preferably secured on or to the end of the pipe 44 in a manner that allows for relative rotation between the pipe 44 and the clamp frame 46. As such, the engagement between the pipe 44 and the clamp frame 46 may be a threaded engagement. In addition to the above, each clamp 42 includes a lead screw 48 that is threadably engaged with the clamp frame 46, a crank handle 50 that is fixedly connected to the distal end of the lead screw 48 outside of the clamp frame 46, and a clamp jaw 52 mounted on the opposing end of the lead screw 48 toward the frame 14 inwardly of the clamp frame 46. The clamp jaw 52 is also slideably mounted on the pipe 44 via a collar portion 53.

By rotating the crank handle 50, the lead screw 48 is advanced or retracted through the clamp frame 46 as a result of the threaded engagement, and the clamp jaw 52 is laterally advanced or retracted axially with respect to a channel 54 defined by the frame 14 of the target system 10. This channel 54 is visible in FIGS. 4A, 4B and 5. As seen in FIGS. 4A and 4B, the clamp jaw 52 has been rotated out of alignment with the channel 54.

In an alternative construction, the retainer 42 may be in a different form of clamp or in a form other than the clamp. For example, the retainer 42 may be a ratcheting clamp having a ratcheting means to move the clamp jaw towards the target and frame, and a release to allow the clamp jaw to be slid away from the target and frame. As a further example, the retainer may simply include a member mounted to the end rails 30 that is rotatable between a first position blocking the end of the channel 54 and a second position where the end of the channel 54 is not blocked. In this regard, the end of the member adjacent to the target 12 may be formed with an inclined or cam surface so as to increasingly exert a force on the target 12, rigidly securing the target in the frame 14, as the member is rotated into the first position.

Figure 7:
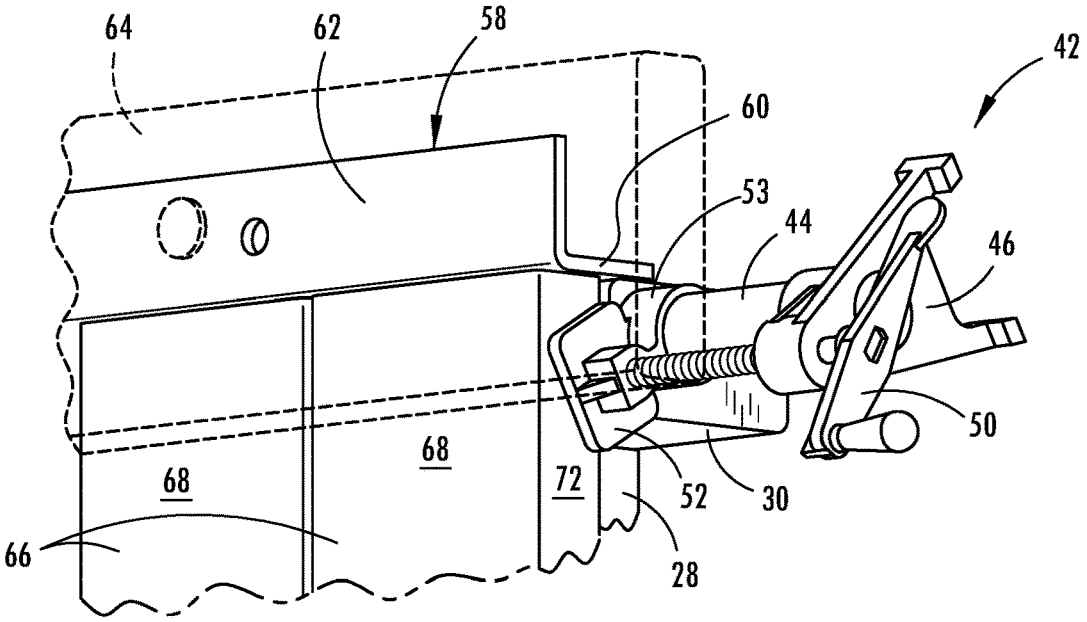
FIG. 7 is s an enlarged upper right side view showing the target loaded in the frame and secured by the upper clamp.
Figure 8:
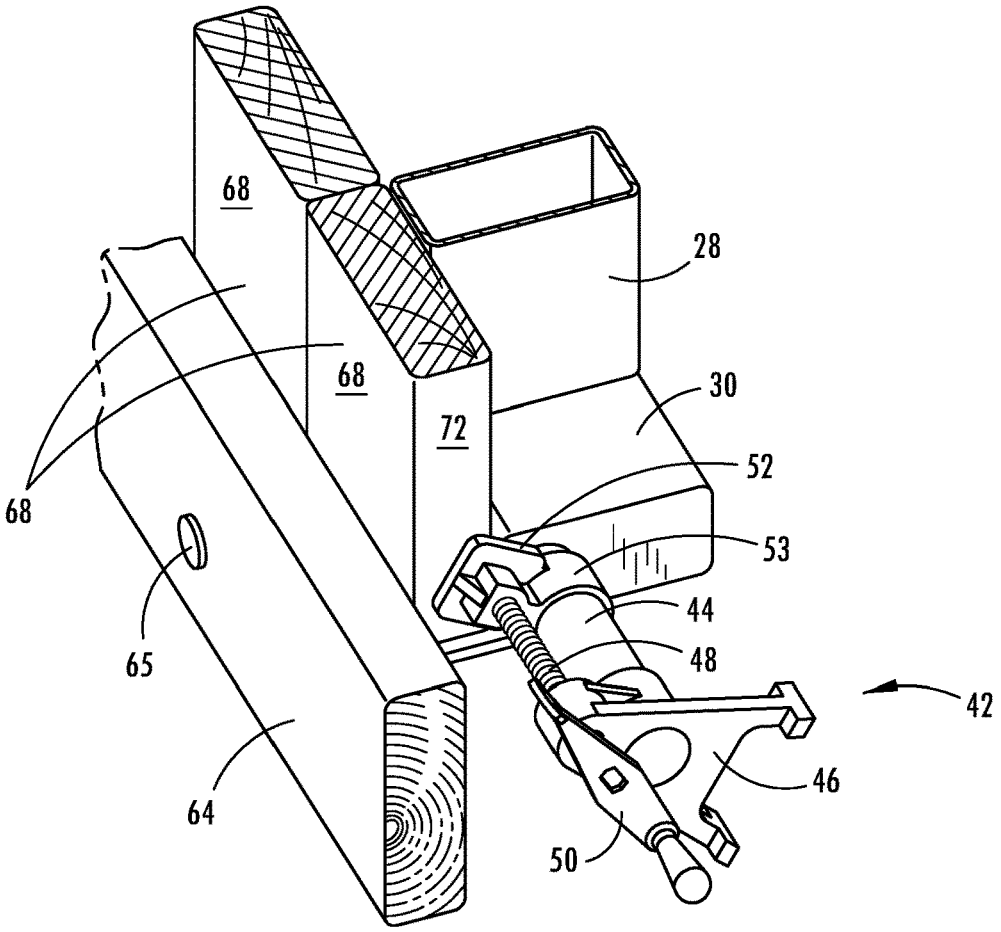
FIG. 8 is s an enlarged lower right side view showing the target loaded in the frame and secured by the clamp.

In the unblocked position of the retainer 42, the target 12 may be inserted or removed, laterally, into and out of the channel 54. In the blocked position of the retainer 42, seen in FIGS. 7 and 8, a target 12 already mounted in the channel 54 of the frame 14 is prevented from being removed from the frame 12.

Figure 5:
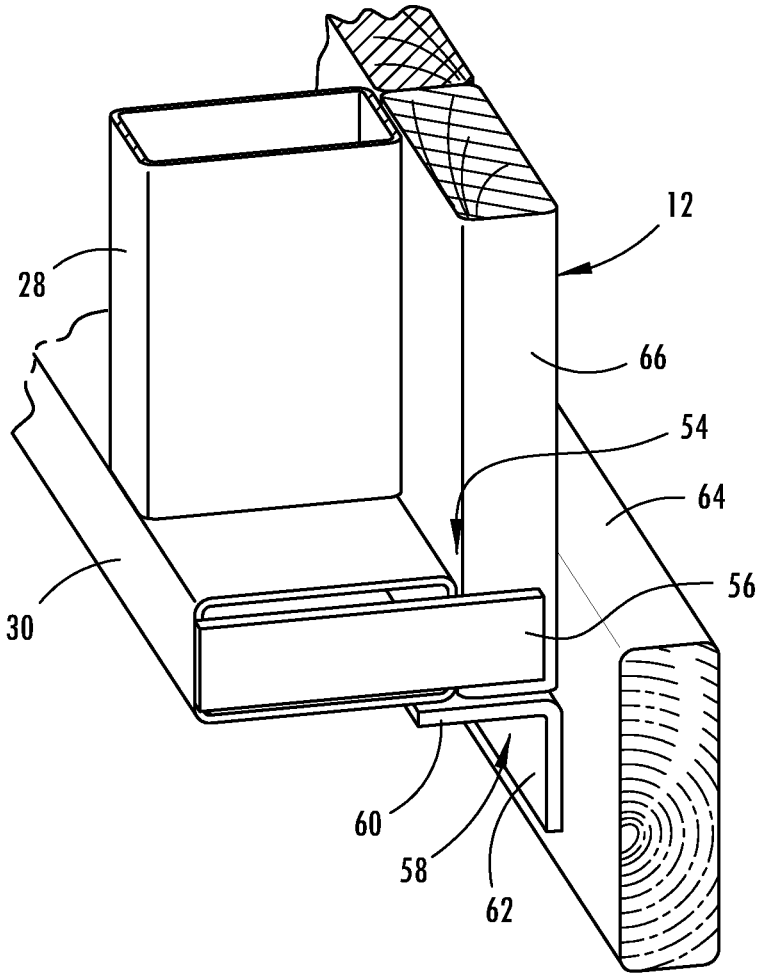
FIG. 5 is an enlarged left side view of the lower part of the sub-frame, the lower sacrificial member, and further shows the end stop of the frame.
Figure 6:
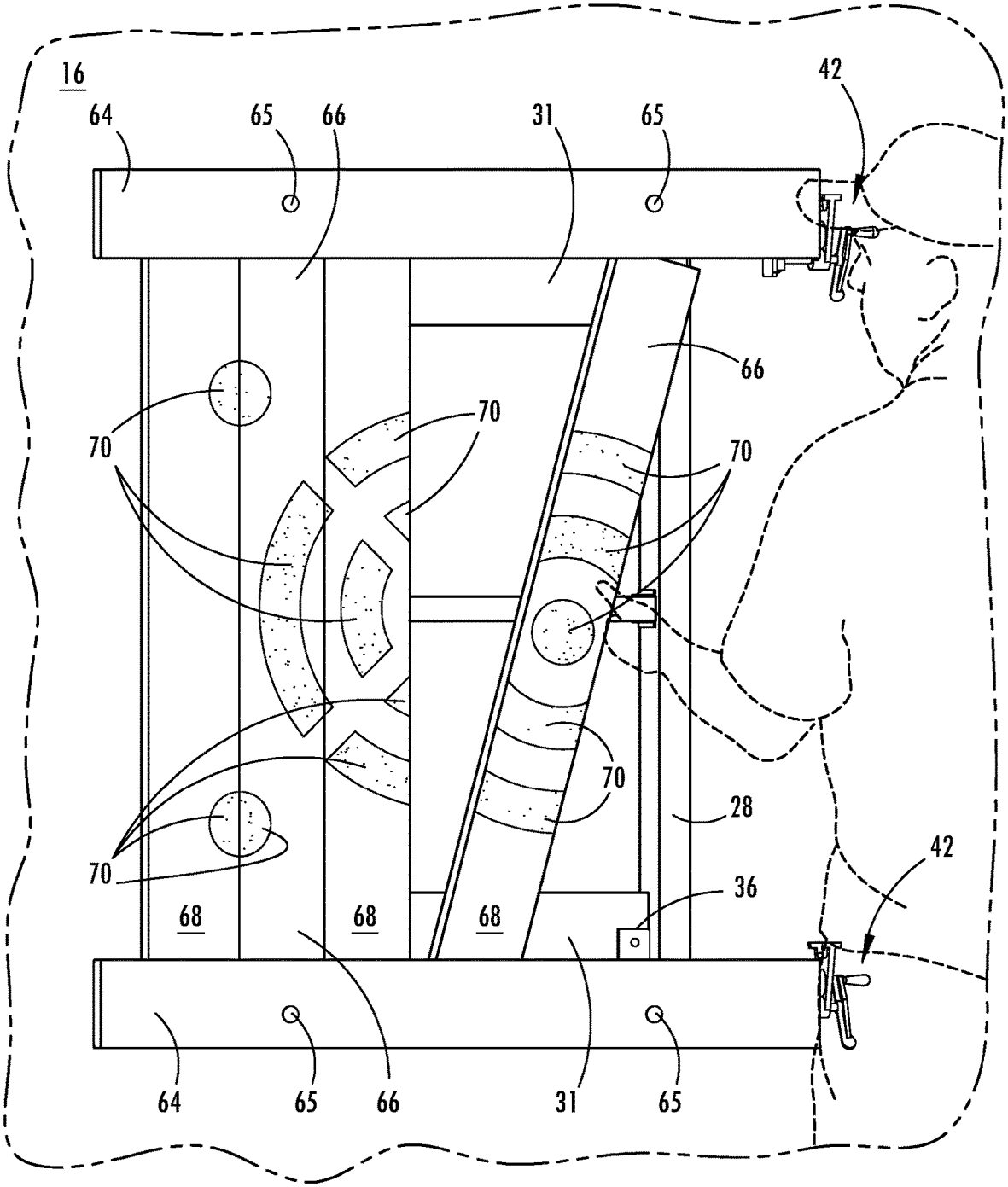
FIG. 6 is a front view of the frame of the target system seen in FIG. 1 and illustrates a target being loaded therein.

Opposing the clamps 42, on the left end of each of the upper and lower end rails 30 and generally defining the left end of the channel 54, is an end stop 56. The end stop 54 of the lower end rail 30 is seen in FIG. 5 and a corresponding end stop 56 is provided on the upper end rail 30 but is not shown. Preferably, the end stops 56 are formed as flanges from flat stock that is welded to the ends of the upper and lower end rails 30 so as to project forward of the front surface of the end rails 30 and define the end of the channel 54. In use, the end stops 56 effectively operate as the opposing contact pads of the clamps 42 provided on the right side of the target system 10.

Extending from and along both the upper and lower end rails 30 is an L-bracket 58. As shown, a portion of the horizontal leg 60 of the L-bracket 58 defines the bottom of the channel 54 and the vertical leg 62 defines a front face, which are spaced forward of the front surfaces of the upper and lower end rails 30. Preferably, the L-brackets 58 are welded or otherwise secured to along the length of the upper and lower end rails 30.

Attached to the vertical legs 62 of each of the L-brackets 58 and forming a final component of the frame 14 are sacrificial members 64. In the illustrated embodiment of the target system 10, the sacrificial members 64 extend toward one another from the vertical legs 62 and define a forward wall of the channel 54, the back wall of the channel 54 being defined by the end rails 30 and the base wall of the channel being defined by the horizontal leg 60 of the L-bracket 58.

In a preferred embodiment, the sacrificial members 64 are formed of wood, preferably dimensional lumber (2×4s), and are attached to the L-brackets 58 by fasteners 65, which may be threaded or other types of removable fasteners. Provided in this manner and defining a front surface of the target system 10, the sacrificial members 64 can receive impacts from thrown hatchets or other projectiles and be readily replaced as needed. Alternatively, the sacrificial members 64 maybe non-sacrificial members provided as permanent portions of the frame 14. In one such alternate construction, the sacrificial member 64 may be replaced by the vertical legs 62 of the L-brackets 58, simply by reversing the direction in which the vertical legs 62 of the L-brackets 58 are oriented.

As noted above, the inner surfaces of the sacrificial members 64 cooperates with the horizontal leg 60 of the L-brackets 58 and the front surfaces the upper and lower end rails 30 to define the channels 54 associated with each of the upper and lower parts 22, 24 of the frame 14. The open side of these channels 54, accordingly, faces in the direction of the opposing channel 54. One end of each channel 54, as noted above, is defined by the previously discussed the end stops 56.

The target 12 of the target system 10 is received and retained within the channels 54. The target 54 itself may be provided as a monolithic structure slid into the channels 54 from the side of the frame 14 having the clamps 42, when the clamps frames 46 are rotated to positions where the contact pads 52 are not aligned with the channels 54. Alternatively, and as illustrated in the figures, the target 12 may be provided as a composite of individual members 66, boards or slats. Dimensional lumber (such as 2×4s) is shown in the figures as forming individual members 66 of the target 12. The front face 68 of the target 12 may be provided with indicia or markings 70, such as a bull's-eye and/or dots, allowing for scoring or aiming when throwing hatchets or other projectiles at the target 12.

The width of the channels 54 (measured from the front surface of the end rails 30 to the inner surface of the sacrificial members 64) is preferably sufficiently wide to receive the target 12 therein allow the target 12 to slide within the channels 54 for installation thereof. Also, the upper and lower channels 54 are spaced apart so that the target 12 is received within the channels and cannot be dislodged from the channels 54 during use.

To install a target 12 in the frame 14, the crank handle 50 of the clamp 42 is rotated to retract the contact pad 52. The clamp frame 46 is rotated away from the channel 54 thereby moving the contact pad 52 out of alignment with the channel 54, as seen in FIG. 5, providing an open end for insertion of the target 12. The target 12 is then slid the channels 54, from the open end, until a lateral side of the target 12 abuts the end stops 56 on the opposing ends of the channels 54. Thus, one side of the target 12 is received in one of the channels 54 and an opposing side of the target 12 is received in the opposing channel 54.

Where the target 12 is comprised of a composite or series of individual members 66, one of the individual members 66 is inserted into the channel 54 and positioned immediately adjacent to the end stops 56. Additional individual members 66 are inserted into the channels, in the appropriate sequence to form the target markings 70, and positioned immediately adjacent to the previously inserted member 66 until all of the required members 66 for defining the desired width of the target 12 have been received in the channels 54. While the individual members 66 may be laterally inserted and slid along the entire length of the channels 54, depending on their length, they also maybe readily inserted by placing one end of the individual member 66 into the channel 54, adjacent to the previously inserted member 66, and rotating the other end of the individual member 66 into the opposing channel 54.

With the target 12 received within the channels 54, the clamp frames 46 are then rotated into a position where the contact pads 52 are aligned with channels 54. This position result in the contact pads 52 opposing a side edge 72 of the target 12. The crank handle 50 is then rotated to advance the lead screw 48 and contact pad 52 into firm engagement with the side edge 72 of the target 12, thereby securely retaining the target 12 between the contact pads 52 and the end stops 56. When the target 12 has been significantly degraded as a result of use, the target 12 may be replaced by reversing the process and inserting a new target 12.

As a person skilled in the art will really appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

I claim:

1. A quick change target system comprising:

a target having a surface defining a target face configured to receive a projectile there into and a width extending across the target face;

a frame having a pair of channel members, each of the channel members being defined by opposing side walls, a bottom wall extending between the side walls, an open top located opposite of the bottom wall, and a pair of ends cooperatively defined by the side walls, the bottom wall and the open top, the channel members being provided on the frame with the open tops facing one another, one of the side walls of each of the channel members extending across the width of the target face and one of the pair of ends being an open end oriented in a direction transverse to the target face; and the target received in the frame and having a first end located in one of the channel members and a second end located in the other of the channel members; and a retainer movable between a first position retaining the target within the frame and a second position permitting removal of the target from the frame, the second position permitting lateral removal of the target through the open end.

2. The target system according to claim 1, wherein the retainer directly engages the target and is at least one of rotationally movable relative to the target or axially movable relative to the target.

3. The target system according to claim 1, wherein the retainer is a clamp, the clamp including a clamp jaw that is axially movable in a direction aligned with a length of one of the channel members.

4. The target system according to claim 3, wherein the clamp jaw is configured to engage a side edge of the target.

5. The target system according to claim 1, wherein one of the side walls is defined by a sacrificial member that is removable from remaining portions of the channel member.

6. The target system according to claim 5, wherein the sacrificial member defines a front surface of the quick change target system.

7. The target system according to claim 1, wherein the target is defined by a plurality of individual members loosely received within and extending between the channel members.

8. The target system according to claim 7, wherein the individual members are formed of wood.

9. The target system according to claim 7, wherein the individual members each include indicia on a face thereof, the indicia collectively defining at least one aiming point on the target face.

10. A quick change target system comprising:

a target having a surface defining a target face configured to receive a projectile there into and a width extending across the target face;

a frame configured to removably receive and support the target, the frame having a skeletal structure including a pair of opposing rails connected by transverse rails extending between the opposing rails, the opposed rails each including a channel receiving the target, the target being loosely received by and extending between the channels of the opposed rails, a portion of the channel being defined by a removably mounted sacrificial member extending across the width of the target face; and a retainer mechanism, the retainer mechanism including a target retaining portion that is movable between a first position permitting withdrawal of the target from the channels and a second position preventing withdrawal of the target from the receiving portions.

11. The target system according to claim 10, wherein the retainer mechanism is a clamp.

12. The target system according to claim 11, wherein the target retainer portion is a moveable clamp jaw.

13. The target system according to claim 10, wherein target retainer portion is movable in at least one of a direction linearly toward the target or rotationally relative to the target.

14. The target system according to claim 13, wherein the target retainer portion is movable in a direction linearly toward a lateral side of the target.

15. The target system according to claim 10, wherein the sacrificial member is formed of a material that is the same as a material forming the target.

16. The target system according to claim 10, wherein the target is defined by a plurality of individual members loosely received within and extending between the channels.

17. The target system according to claim 16, wherein the individual members are provided in the form of dimensional lumber.

18. The target system according to claim 16, wherein the individual members each include indicia on a face thereof, the indicia collectively defining at least one aiming point on the target.

19. A quick change target system comprising:

a target, the target being defined by a plurality of individual members, the individual members each including indicia on a face thereof, the indicia collectively defining at least one aiming point on the target;

a frame configured to removably receive and support the target, the frame having a skeletal structure including a pair of opposing rails and transverse rails extending between the opposing rails, the opposed rails including receiving portions formed as channels receiving the target, the target being loosely received by and extending between the receiving portions; and a retainer mechanism, the retainer mechanism including an end stop on one end of each of the channels and a target retaining portion on an opposing end of each of the channels, the target retaining portions being axially movable toward the end stops between a first position permitting withdrawal of the target from the receiving portions and a second position preventing withdrawal of the target from the receiving portions, whereby the target is retained with the frame between the end stop and the target retaining portion.

* * * * *